US011104131B2

(12) United States Patent
Ikeuchi et al.

(10) Patent No.: US 11,104,131 B2
(45) Date of Patent: Aug. 31, 2021

(54) LIQUID DISCHARGE HEAD AND RECORDING APPARATUS THAT USES IT

(71) Applicant: KYOCERA Corporation, Kyoto (JP)

(72) Inventors: Wataru Ikeuchi, Kirishima (JP); Kenichi Yoshimura, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/651,588

(22) PCT Filed: Sep. 28, 2018

(86) PCT No.: PCT/JP2018/036415
§ 371 (c)(1),
(2) Date: Mar. 27, 2020

(87) PCT Pub. No.: WO2019/066019
PCT Pub. Date: Apr. 4, 2019

(65) Prior Publication Data

US 2020/0254760 A1 Aug. 13, 2020

(30) Foreign Application Priority Data

Sep. 28, 2017 (JP) ..... JP2017-188495

(51) Int. Cl.
*B41J 2/14* (2006.01)
*B41J 11/00* (2006.01)
*B41M 7/00* (2006.01)

(52) U.S. Cl.
CPC ..... *B41J 2/14201* (2013.01); *B41J 11/002* (2013.01); *B41M 7/0027* (2013.01); *B41J 2002/14419* (2013.01)

(58) Field of Classification Search
CPC ..... B41J 2/14201; B41J 11/002; B41J 2002/14419; B41J 2/14; B41M 7/0027
See application file for complete search history.

(56) References Cited

U.S. PATENT DOCUMENTS

2015/0210076 A1 7/2015 Rivas et al.
2016/0338154 A1 11/2016 Nagahisa
(Continued)

FOREIGN PATENT DOCUMENTS

JP 2009-143168 A 7/2009
JP 2016-213139 A 12/2016
(Continued)

OTHER PUBLICATIONS

IP.com search (Year: 2020).*

*Primary Examiner* — Lisa Solomon
(74) *Attorney, Agent, or Firm* — Volpe Koenig

(57) ABSTRACT

A liquid discharge head includes a flow channel member that includes discharge holes, pressurizing chambers that are linked to the discharge holes, respectively, a first common flow channel(s) that is/are commonly linked to the pressurizing chambers, a second common flow channel(s) that is/are commonly linked to the pressurizing chambers, a first flow channel that links the pressurizing chambers and the first common flow channel(s), and a second flow channel that links the pressurizing chambers and the second common flow channel(s), and pressurizing parts that pressurize the pressurizing chambers, respectively, wherein the first flow channel includes a first connection flow channel that connects the first common flow channel(s) and first separate flow channels that are linked to one of the pressurizing chambers, and one of the first common flow channel(s) includes sets that are composed of the first connection flow channel and the first separate flow channels.

20 Claims, 9 Drawing Sheets

(56) References Cited

U.S. PATENT DOCUMENTS

| | | | |
|---|---|---|---|
| 2017/0165981 | A1 | 6/2017 | Kuwabara et al. |
| 2017/0282556 | A1 | 10/2017 | Hozumi et al. |
| 2019/0001673 | A1 | 1/2019 | Horiuchi et al. |

FOREIGN PATENT DOCUMENTS

| | | | |
|---|---|---|---|
| JP | 2017-105130 | A | 6/2017 |
| WO | 2016/031871 | A1 | 3/2016 |
| WO | 2017/018484 | A1 | 2/2017 |

* cited by examiner

LIQUID DISCHARGE HEAD AND RECORDING APPARATUS THAT USES IT

CROSS-REFERENCE TO RELATED APPLICATIONS

This application is a national stage application of International Application No. PCT/JP2018/036415, filed on Sep. 28, 2018, which designates the United States, the entire contents of which are herein incorporated by reference, and which is based upon and claims the benefit of priority to Japanese Patent Application No. 2017-188495, filed on Sep. 28, 2017, the entire contents of which are herein incorporated by reference.

FIELD

The present disclosure relates to a liquid discharge head and a recording apparatus that uses it.

BACKGROUND

For example, a liquid discharge head that discharges a liquid to a printing paper sheet to execute various types of printing has conventionally been known as a head for printing. For example, a lot of discharge holes that discharge liquids are arranged on a liquid discharge head so as to extend two-dimensionally. Liquids that are discharged from respective discharge holes land on a printing paper sheet side by side to execute printing (see, for example, Patent Literature 1).

CITATION LIST

Patent Literature

Patent Literature 1: Japanese Patent Application Publication No. 2009-143168

SUMMARY

A liquid discharge head according to the present disclosure includes a flow channel member and a plurality of pressurizing parts. The flow channel member has a plurality of discharge holes, a plurality of pressurizing chambers, one or more first common flow channels, one or more second common flow channels, a first flow channel, and a second flow channel. The plurality of pressurizing chambers are linked to the plurality of discharge holes, respectively. The first common flow channel(s) is/are commonly linked to the plurality of pressurizing chambers. The second common flow channel(s) is/are commonly linked to the plurality of pressurizing chambers. The first flow channel links the pressurizing chambers and the first common flow channel(s). The second flow channel links the pressurizing chambers and the second common flow channel(s). The plurality of pressurizing parts pressurize the plurality of pressurizing chambers, respectively. The first flow channel has a first connection flow channel that connects the first common flow channel(s) and a plurality of first separate flow channels that are linked to one of the pressurizing chambers. One of the first common flow channel(s) has a plurality of sets that are composed of the first connection flow channel and the plurality of first separate flow channels.

Furthermore, a recording apparatus according to the present disclosure is characterized by including the liquid discharge head, a conveyance part that conveys a printing paper sheet to the liquid discharge head, and a control part that controls the liquid discharge head.

DESCRIPTION OF EMBODIMENTS

Figure 1A:
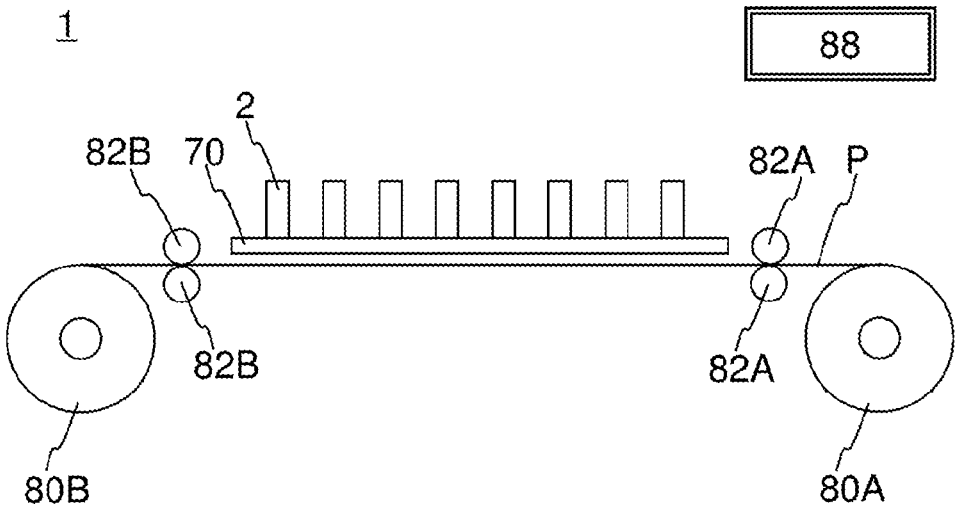
FIG. 1A is a side view of a recording apparatus that includes a liquid discharge head according to an embodiment of the present disclosure and FIG. 1B is a plan view thereof.
Figure 1B:
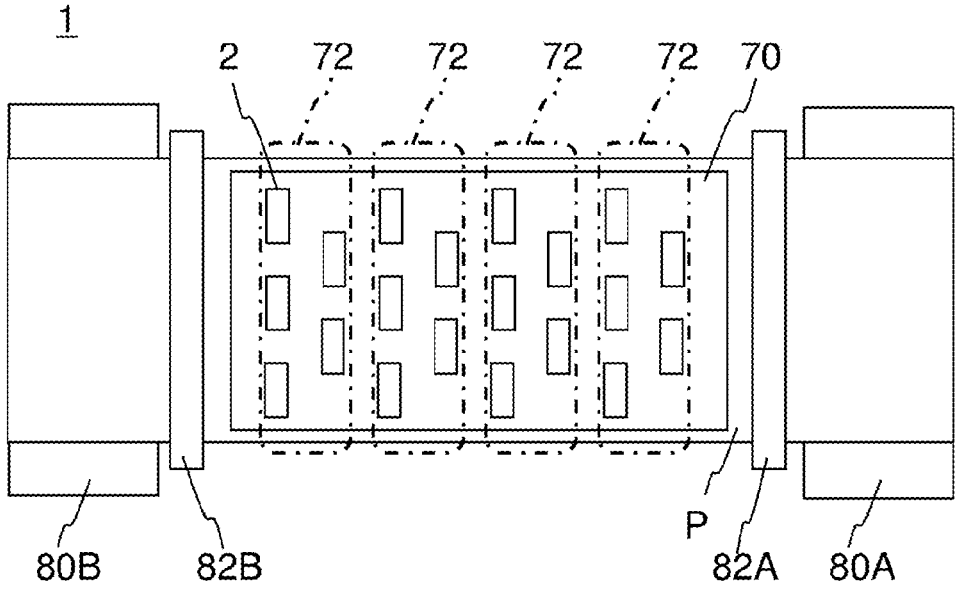

FIG. 1A is a schematic side view of a color ink-jet printer 1 (that may simply be referred to as a printer below) that is a recording apparatus that includes a liquid discharge head 2 according to an embodiment of the present disclosure and FIG. 1B is a schematic plan view thereof. The printer 1 conveys a printing paper sheet P from guide rollers 82A to conveyance rollers 82B, so that the printing paper sheet P is relatively moved with respect to the liquid discharge head 2. A control part 88 controls the liquid discharge head 2 based on data of an image or a character, so that a liquid is discharged toward a printing paper sheet P to land a liquid drop on the printing paper sheet P and recording such as printing is executed on the printing paper sheet P.

In the present embodiment, the liquid discharge head 2 is fixed with respect to the printer 1 and the printer 1 is a so-called line printer. For another embodiment of a recording apparatus, a so-called serial printer is provided where an operation to execute recording while the liquid discharge head 2 is moved in a direction that intersects with a conveyance direction of a printing paper sheet P, for example, is reciprocated in a direction that is substantially orthogonal thereto or the like, and conveyance of the printing paper sheet P are executed alternately.

A head mounting frame 70 with a flat plate shape (that may simply be referred to as a frame below) is fixed on the printer 1 so as to be substantially parallel to a printing paper sheet P. Twenty non-illustrated holes are provided on the frame 70 and twenty liquid discharge heads 2 are mounted at respective hole portions so that liquid-discharging sites of the liquid discharge heads 2 face a printing paper sheet P. A distance between the liquid discharge heads 2 and a printing paper sheet P is, for example, approximately 0.5 to 20 mm. Five liquid discharge heads 2 compose one head group 72 and the printer 1 has four head groups 72.

The liquid discharge head 2 has an elongated shape that is elongated in a direction from a front to a back of FIG. 1A or upward and downward directions of FIG. 1B. In one head group 72, three liquid discharge heads 2 are aligned in a direction that intersects with a conveyance direction of a printing paper sheet P, for example, a direction that is substantially orthogonal thereto, and two other liquid discharge heads 2 are aligned at positions that are displaced in the conveyance direction to provide each thereof between the three liquid discharge heads 2 one by one. The liquid discharge heads 2 are arranged in such a manner that ranges that are printable by respective liquid discharge heads 2 are linked in a width direction of a printing paper sheet P, that is, a direction that intersects with a conveyance direction of the printing paper sheet P, or edges thereof are overlapped, so that it is possible to execute printing without a gap in the width direction of the printing paper sheet P.

The four head groups 72 are arranged in a conveyance direction of a printing paper sheet P. Each liquid discharge head 2 is supplied with a liquid, for example, an ink, from a non-illustrated liquid tank. Liquid discharge heads 2 that belong to one head group 72 are supplied with inks with an identical color, so that it is possible for the four head groups 72 to execute printing with four colored inks. Colors of inks that are discharged from respective head groups 72 are, for example, magenta (M), yellow (Y), cyan (C), and black (B). If such inks are controlled by the control part 88 to execute printing, it is possible to print a color image.

The number of a liquid discharge head(s) 2 that is/are mounted on the printer 1 may be one if printing with a single color is executed within a range that is printable by one liquid discharge head 2. It is possible to change the number of a liquid discharge head(s) 2 that is/are included in a head group 72 or the number of a head group(s) 72 appropriately depending on a target to be printed or a printing condition(s). For example, the number of a head group(s) 72 may be increased in order to execute printing with more colors. Furthermore, if a plurality of head groups 72 that execute printing with an identical color are arranged and printing is alternately executed in a conveyance direction, it is possible to increase a conveyance speed even if liquid discharge heads 2 with an identical performance are used. Thereby, it is possible to increase a printing surface area per time. Furthermore, a plurality of head groups 72 that execute printing with an identical color may be prepared and arranged to be displaced in a direction that intersects with a conveyance direction so as to increase a resolution in a width direction of a printing paper sheet P.

Moreover, printing with a liquid such as a coating agent may be executed in order to execute surface treatment of a printing paper sheet P, other than printing with a colored ink being executed.

A printing paper sheet P is provided in a state where it is wound around a paper feed roller 80A before use thereof, passes between two guide rollers 82A, subsequently passes through an underside of the liquid discharge heads 2 that are mounted on the frame 70, subsequently passes between two conveyance rollers 82B, and is finally recovered by a recovery roller 80B. When printing is executed, the conveyance rollers 82B are rotated, so that a printing paper sheet P is conveyed at a constant speed, and printing is executed by the liquid discharge heads 2. The recovery roller 80B winds a printing paper sheet P that is sent from the conveyance rollers 82B. A conveyance speed is, for example, 100 m/minute. Each roller may be controlled by the control part 88 or may be operated manually by a person.

Furthermore, a printing target may be a roll-shaped fabric or the like other than a printing paper sheet P. Furthermore, the printer 1 may mount and convey a printing paper sheet P on a conveyance belt, instead of executing direct conveyance thereof. In such a case, it is possible to provide a flat paper sheet, a cut fabric, a wood, a tile, or the like as a printing target. Moreover, a liquid that includes an electrically conductive particle may be discharged from the liquid discharge head 2 so as to print a wiring pattern for an electronic device or the like. Still further, a predetermined amount of a liquid chemical agent or a liquid that includes a chemical agent may be discharged from the liquid discharge head 2 toward a reaction container or the like and be reacted or the like so as to fabricate a chemical product.

Furthermore, a position sensor, a speed sensor, a temperature sensor, or the like may be installed in the printer 1 and the control part 88 may control each part of the printer 1 depending on a state of each part of the printer 1 that is known from information from each sensor. For example, in a case where a temperature of the liquid discharge head 2, a temperature of a liquid in a liquid tank, a pressure that is applied to the liquid discharge head 2 by a liquid in a liquid tank, or the like, influences a discharge characteristic of a liquid to be discharged, that is, a discharge amount, a discharge speed, or the like, or the like, a driving signal to discharge a liquid may be changed depending on such information.

Figure 2A:
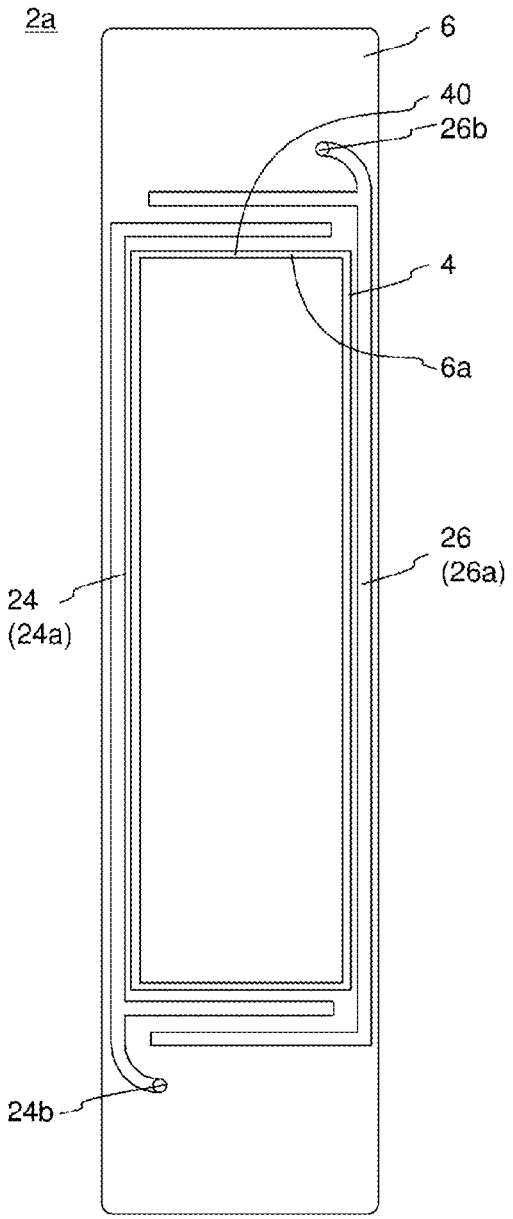
FIG. 2A is a plan view of a head body that is a main part of a liquid discharge head in FIG. 1A and FIG. 1B
Figure 2B:
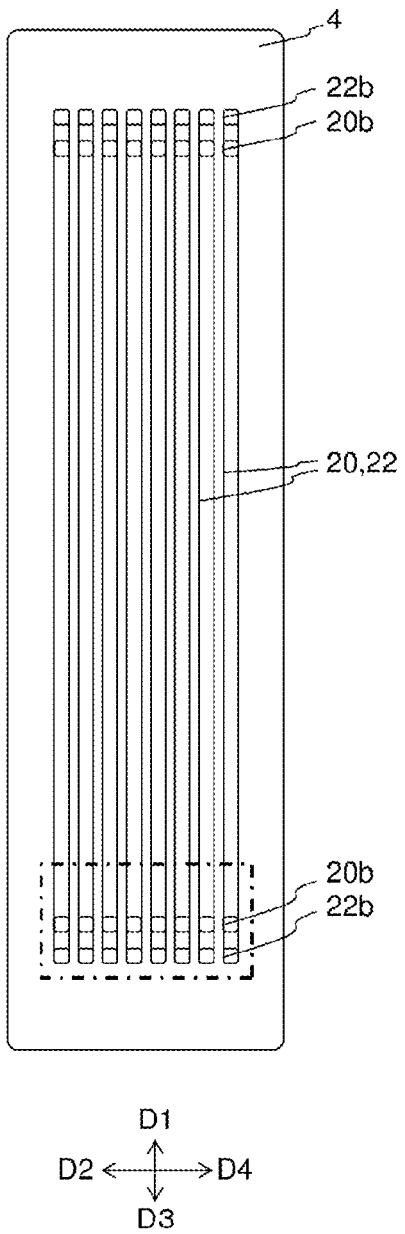
FIG. 2B is a plan view where a second flow channel member is eliminated from FIG. 2A.
Figure 3:
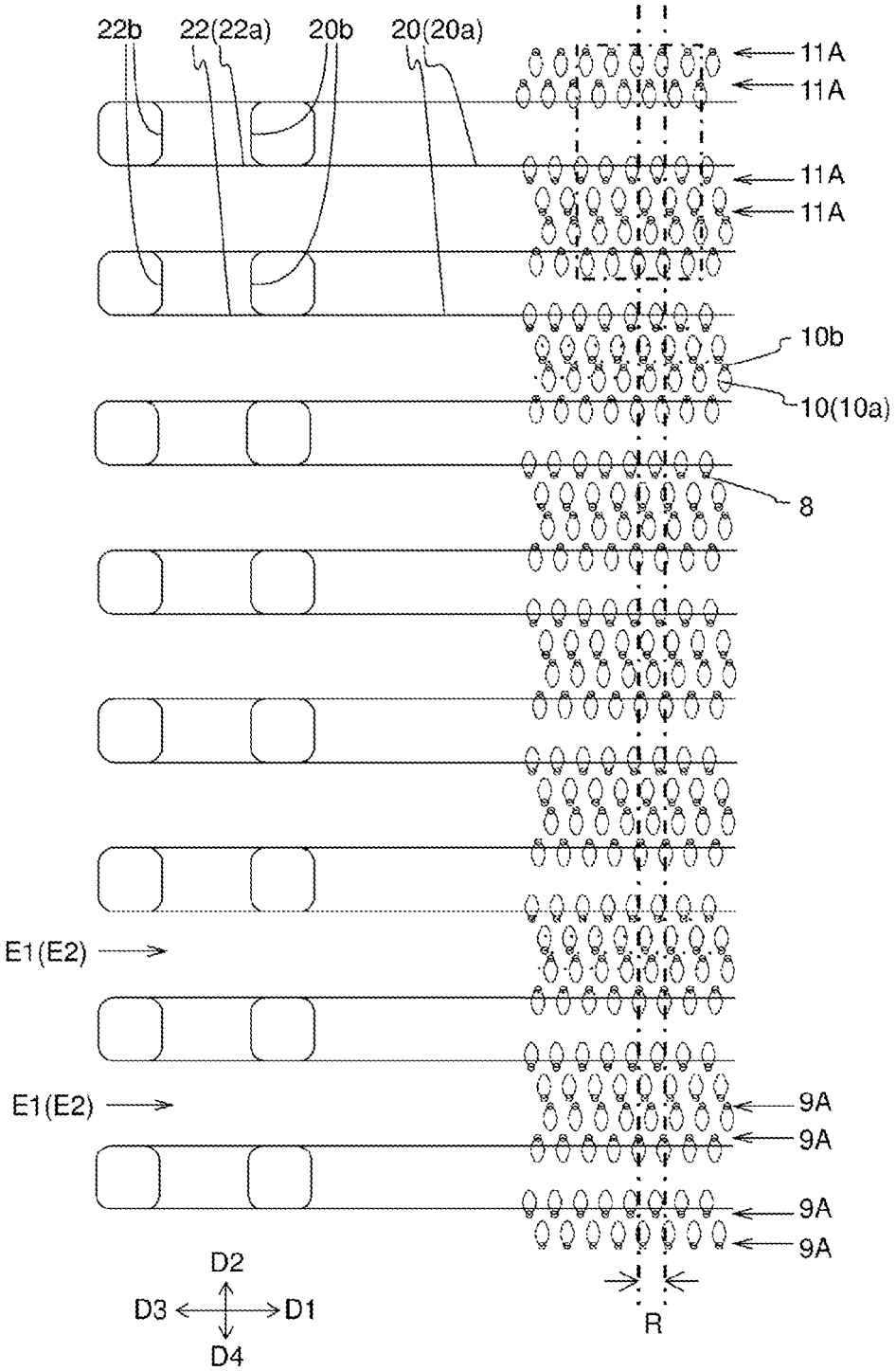
FIG. 3 is an enlarged plan view of a part of FIG. 2B.
Figure 4:
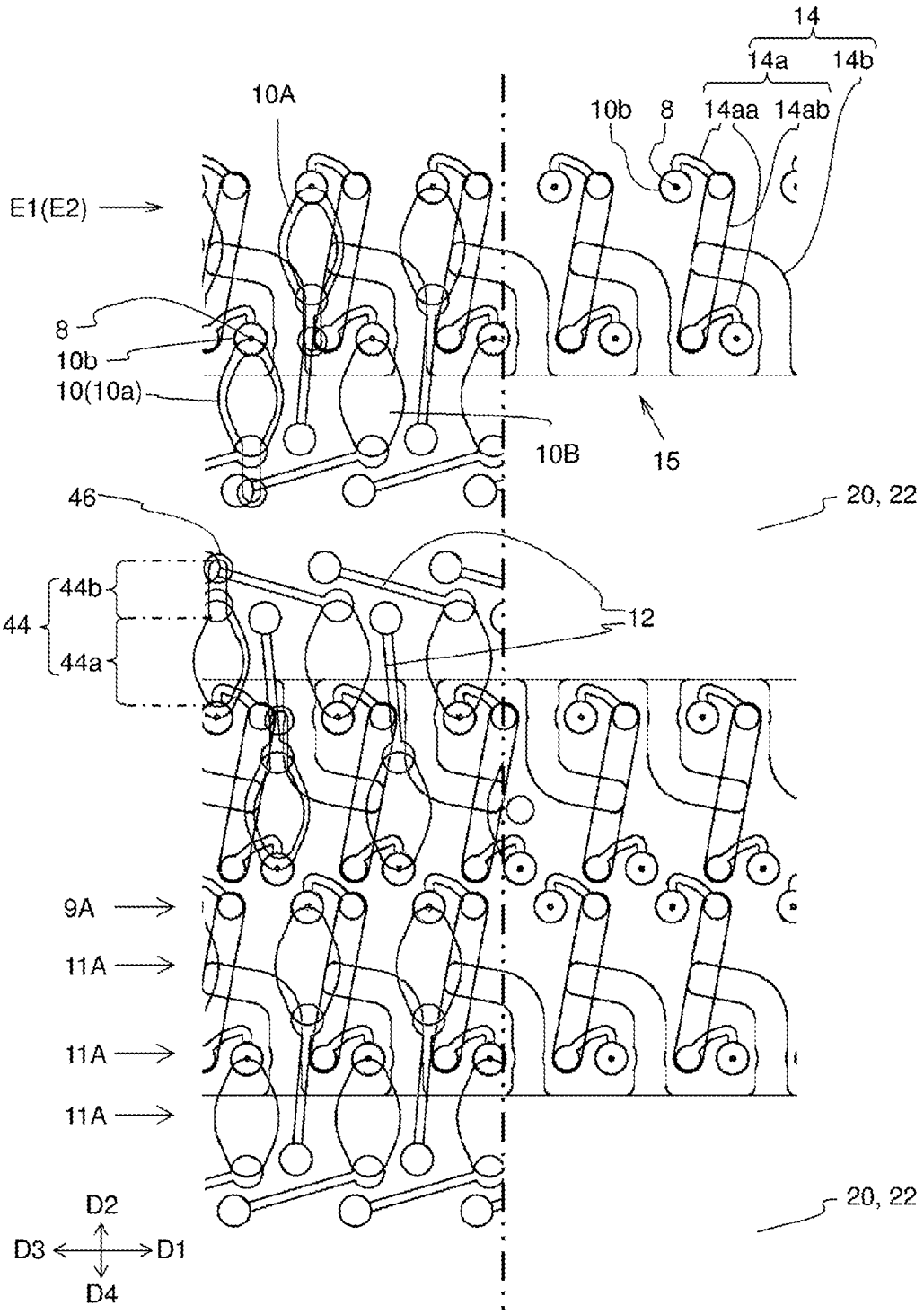
FIG. 4 is an enlarged plan view of a part of FIG. 2B.
Figure 5A:
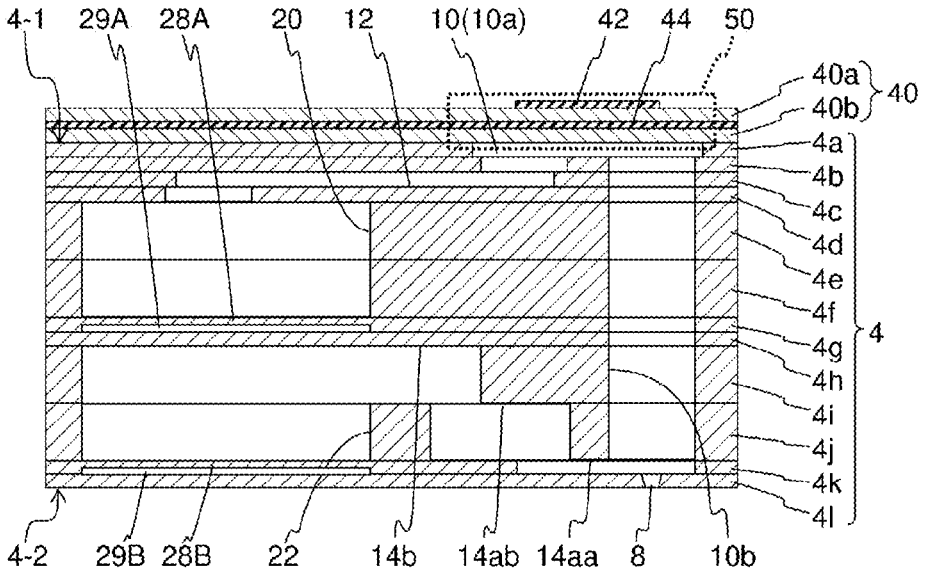
FIG. 5A is a schematic partial longitudinal cross-sectional view of a head body and FIG. 5B is a longitudinal cross-sectional view of another part of the head body.
Figure 5B:
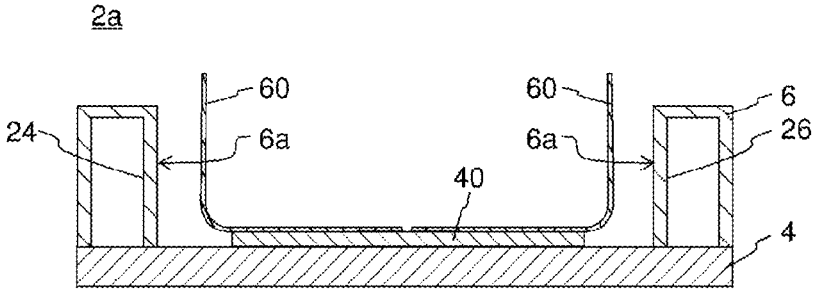

Next, the liquid discharge head 2 according to an embodiment of the present disclosure will be explained. FIG. 2A is a plan view that illustrates a head body 2*a* that is a main part of the liquid discharge head 2 as illustrated in FIG. 1A and FIG. 1B. FIG. 2B is a plan view of a state where a second flow channel member 6 is eliminated from the head body 2*a*. FIG. 3 is an enlarged plan view of the head body 2*a* within a range with a dashed-dotted line in FIG. 2B. FIG. 4 is an enlarged plan view of the head body 2*a* within a range with a dashed-dotted line in FIG. 3. FIG. 5A is a schematic partial longitudinal cross-sectional view of the head body 2*a*. FIG. 5A depicts flow channels that are not present in an identical longitudinal cross section in practice as if they were present in the identical longitudinal cross section, in order to illustrate a state where such flow channels are linked. In more detail, longitudinal cross sections of a site above a plate 4*g* and that above a plate 4*h* are different. FIG. 5B is a longitudinal cross-sectional view of another part of the head body 2*a*. However, FIG. 5B illustrates signal transmission parts 60 that are not depicted in FIG. 2A.

For readily understanding the drawing(s), each figure is depicted as follows. FIG. 2A to FIG. 4 depict, by a solid line, a flow channel or the like that is provided under another object and should be depicted by a broken line. FIG. 4 depicts a left side with respect to a central dashed-two dotted line that divides a view into right and left while a pressurizing chamber body 10*a*, a second flow channel 12, a separate electrode 44, and a connection electrode 46 are omitted. For a separate electrode 44 and a connection electrode 46, ones that correspond to four pressurizing chambers 10 in an upper left part of such a figure are illustrated.

The head body 2*a* includes a first flow channel member 4, a second flow channel member 6 that supplies a liquid to the first flow channel member 4, and a piezoelectric actuator substrate 40 where a displacement element 50 that is a pressurizing part is formed therein. The head body 2*a* has a flat plate shape that is longer in one direction where such a direction may be referred to as a longitudinal direction. Furthermore, the second flow channel member 6 serves as a supporting member that supports a structure of the head body 2*a* where the head body 2*a* is fixed on the frame 70 (see FIG. 1) at each of both end parts of the second flow channel member 6 in a longitudinal direction thereof. Additionally, the liquid discharge head 2 may include a housing, a driver IC, a wiring substrate, and the like, other than the head body 2*a*.

The first flow channel member 4 that composes head body 2*a* has a flat-plate-like shape and a thickness thereof is approximately 0.5 to 2 mm. On a pressurizing chamber surface 4-1 that is one surface of the first flow channel member 4, a lot of pressurizing chambers 10 are aligned and arranged in a planar direction thereof. On a discharge hole surface 4-2 of the first flow channel member 4 that is a surface that is opposite to the pressurizing chamber surface 4-1, a lot of discharge holes 8 that discharge liquids are aligned and arranged in a planar direction thereof. The discharge holes 8 are linked to the pressurizing chambers 10, respectively. Hereinafter, the pressurizing chamber surface 4-1 will be explained as being positioned above the discharge hole surface 4-2.

On the first flow channel member 4, a plurality of second common flow channels 20 and a plurality of first common flow channels 22 are arranged so as to extend in a first direction. Hereinafter, a second common flow channel(s) 20 and a first common flow channel(s) 22 may collectively be referred to as a common flow channel(s). A second common flow channel 20 and a first common flow channel 22 are arranged so as to be overlapped. A second direction is provided as a direction that intersects with a first direction. Eight second common flow channels 20 and eight first common flow channels 22 are respectively aligned and arranged in a second direction. Additionally, a first direction is a direction that is identical to a longitudinal direction of the head body 2*a*. Furthermore, a third direction is provided as a direction that is opposite to a first direction and a fourth direction is provided as a direction that is opposite to a second direction. In a part of figures, first to fourth directions are indicated by D1 to D4.

On both sides of the second common flow channel 20 and the first common flow channel 22, pressurizing chambers 10 that are linked to the second common flow channel 20 and the first common flow channel 22 and the discharge holes 8 that are linked to the pressurizing chambers 10 are aligned. The pressurizing chambers 10 compose two of pressurizing chamber lines 11A on one side of each of the second common flow channel 20 and the first common flow channel 22 or collectively four thereof on both sides thereof. Furthermore, the discharge holes 8 compose two of discharge hole lines 9A on one side of each of the second common flow channel 20 and the first common flow channel 22 or collectively four thereof on both sides thereof. Eight second common flow channels 20 and eight first common flow channels 22 are provided, so that thirty two pressurizing chamber lines 11A are provided in total and thirty two discharge hole lines 9A are also provided in total.

The second common flow channel 20 is linked to four lines of pressurizing chambers 10 that are aligned on both sides thereof, via a second flow channel 12. The first common flow channel 22 is linked to four lines of pressurizing chambers 10 that are aligned on both sides thereof, via a first flow channel 14.

In a configuration as provided above, on the first flow channel member 4, a liquid that is supplied to the second common flow channel 20 flows into the pressurizing chambers 10 that are aligned along the second common flow channel 20. A part of a liquid that is flown into the pressurizing chambers 10 is discharged from the discharge holes 8. Another part that is not discharged therefrom flows into the first common flow channel 22 and is emitted from the first flow channel member 4 to an outside thereof. Additionally, a flow of supply and recovery of a liquid may be reversed.

The second common flow channel 20 is arranged so as to overlap with the first common flow channel 22. The second common flow channel 20 is opened to an outside of the first flow channel member 4 at openings 20*b* that are arranged at both end parts thereof in a first direction and a third direction, outside a range where the second flow channel 12 is linked thereto. The first common flow channel 22 is opened to an outside of the first flow channel member 4 at openings 22*b* that are arranged at both end parts thereof in a first direction and a third direction, outside a range where the first flow channel 14 is linked thereto and outside the openings 20*b* of the second common flow channel 20. An opening 22*b* of the first common flow channel 22 that is arranged on a lower side is arranged outside an opening 20*b* of the second common flow channel 20 that is arranged on an upper side, so that a space efficiency is improved. Additionally, an entirety of a second common flow channel body 20*a* where both end parts are excluded is arranged on an underside of an entirety of the first common flow channel body 22*a* where both end parts are excluded.

Substantially identical amounts of liquids are supplied from an opening 20*b* of the second common flow channel on a first direction side and an opening 20*b* on a third direction side and flow toward a center of the second common flow channel 20. In a case where discharge amounts of liquids from discharge holes 8 that are linked to one second common flow channel 20 and one first common flow channel 22 are substantially constant independently of a place thereof, a flow on the second common flow channel 20 is decelerated toward a center thereof and is zero (0) substantially at the center. A flow on the first common flow channel 22 is opposite thereto and is zero substantially at a center thereof, and such a flow is accelerated toward an outside thereof.

The liquid discharge head 2 records a variety of things, so that discharge amounts of liquids from discharge holes 8 that are linked to one second common flow channel 20 and one first common flow channel 22 have a variety of distributions. In a case where a discharge amount for a discharge hole 8 on a first direction side is greater, a place where a flow is zero is provided on a first direction side relative to a center. On the other hand, in a case where a discharge amount for a discharge hole 8 on a third direction side is greater, a place where a flow is zero is provided on a third direction side relative to a center. Thus, a distribution of discharging is changed depending on a thing to be recorded, so that a place where a flow is zero is moved. Thereby, even if a flow is zero at a certain moment in such a manner that a liquid is retained, a distribution of discharging is changed and thereby retention thereof at such a place is resolved, so that it is possible to prevent precipitation of a pigment, fixation of a liquid, or the like that is caused by such a liquid that continues to be retained at an identical place, from being readily caused.

A pressure that is applied to a part of the second flow channel 12 that is linked to the second common flow channel 20 on a side of the second common flow channel 20 is changed depending on a position (mainly a position in a first direction) where the second flow channel 12 is linked to the second common flow channel 20, according to an influence of a pressure loss. A pressure that is applied to a part on a side of the first flow channel 14 that is linked to the first common flow channels 22 is changed depending on a position (mainly a position in a first direction) where the first flow channel 14 is linked to the first common flow channel 22, according to an influence of a pressure loss. If a pressure of a liquid in one discharge hole is zero, a pressure change as described above is changed symmetrically, so that it is possible to provide pressures of liquids that are substantially zero in all of the discharge holes 8.

A surface on an underside of the second common flow channel 20 is a damper 28A. A surface of the damper 28A on an opposite side of a surface that faces the second common flow channel 20 faces a damper chamber 29A. A gas such as air is put in the damper chamber 29A and a volume thereof is changed depending on a pressure that is applied from the second common flow channel 20. A volume of the damper chamber 29A is changed so that it is possible for the damper 28A to vibrate, and such vibration is damped so that it is possible to damp a pressure variation that is caused in the second common flow channel 20. The damper 28A is provided so that it is possible to decrease a pressure variation such as resonance of a liquid in the second common flow channel 20.

A surface on a lower side of the first common flow channel 22 is a damper 28B. A surface of the damper 28B on an opposite side of a surface that faces the first common flow channel 22 faces a damper chamber 29B. Similarly to a case of the second common flow channel 20, the damper 28B is provided so that it is possible to decrease a pressure variation such as resonance of a liquid in the first common flow channel 22.

On one discharge hole line 9A, discharge holes 8 are arranged at intervals of 50 dpi (approximately 25.4 mm/50). Thirty two discharge hole lines 9A are provided and the discharge holes 8 that are included therein are arranged to be displaced from one another in a first direction, so that the discharge holes 8 are arranged at intervals of 1600 dpi in total.

More specifically, in FIG. 3, as the discharge holes 8 are projected in a direction that is orthogonal to a first direction, the thirsty two discharge holes 8 are projected in a range between a virtual straight lines R, so that respective discharge holes 8 are aligned at intervals of 1200 dpi inside the virtual straight lines R. Thereby, if a printing paper sheet P is conveyed in a direction that is orthogonal to a virtual straight line R and printing is executed thereon, it is possible to execute printing at a resolution of 1200 dpi.

The second flow channel member 6 is joined to the pressurizing chamber surface 4-1 of the first flow channel member 4 and has a first integration flow channel 24 that supplies a liquid to the second common flow channel 20 and a second integration flow channel 26 that recovers such a liquid on the first common flow channel 22. A thickness of the second flow channel member 6 is greater than that of the first flow channel member 4 and is approximately 5 to 30 mm.

The second flow channel member 6 is joined to a region where a piezoelectric actuator substrate 40 is not connected, on the pressurizing chamber surface 4-1 of the first flow channel member 4. More specifically, joining thereof is executed so as to surround the piezoelectric actuator substrate 40. Thereby, it is possible to suppress attaching of a part of a discharged liquid as a mist to the piezoelectric actuator substrate 40. Furthermore, an outer periphery of the first flow channel member is fixed so as to surround the piezoelectric actuator substrate 40, so that it is possible to decrease resonance that is caused by vibrating the first flow channel member 4 according to driving of the displacement element 50.

On an end part of the first integration flow channel 24 in a third direction, an opening 24*b* that is opened to a top surface of the second flow channel member 6 is arranged. The first integration flow channel 24 is branched into two in a middle thereof where one of them is linked to an opening 20*b* of the second common flow channel 20 on a third direction side and the other is linked to an opening 20*b* of the second common flow channel 20 on a first direction side. On an end part of the second integration flow channel 26 in a first direction, an opening 26*b* that is opened to a top surface of the second flow channel member 6 is arranged. The second integration flow channel 26 is branched into two in a middle thereof where one of them is linked to an opening 22*b* of the first common flow channel 22 on a first direction side and the other is linked to an opening 22*b* of the first common flow channel 22 on a third direction side. In a case where printing is executed, a liquid is supplied from an outside to the opening 24*b* of the first integration flow channel 24 and a liquid that is not discharged is recovered from the opening 26*b* of the second integration flow channel 26.

Furthermore, on the second flow channel member 6, a through-hole 6*a* that penetrates the second flow channel member 6 upwardly and downwardly is arranged. A signal transmission part such as a Flexible Printed Circuit (FPC) that transmits a driving signal to drive the piezoelectric actuator substrate 40 passes through the through-hole 6*a*.

The first integration flow channel 24 is arranged on the second flow channel member 6 that is different from the first flow channel member 4 and is thicker than the first flow channel member 4, so that it is possible to increase a cross-sectional area of the first integration flow channel 24 and thereby it is possible to decrease a difference in a pressure loss that is caused by a difference between positions where the first integration flow channel 24 and the second common flow channel 20 are linked. A flow channel resistance of the first integration flow channel 24 may be 1/100 or less of that of the second common flow channel 20. Herein, a flow channel resistance of the first integration flow channel 24 is more accurately a flow channel resistance of the first integration flow channel 24 in a range where the second common flow channel 20 is linked thereto.

The second integration flow channel 26 is arranged on the second flow channel member 6 that is different from the first flow channel member 4 and is thicker than the first flow channel member 4, so that it is possible to increase a cross-sectional area of the second integration flow channel 26 and thereby it is possible to decrease a difference in a pressure loss that is caused by a difference between positions where the second integration flow channel 26 and the first common flow channel 22 are linked. A flow channel resistance of the second integration flow channel 26 may be 1/100 or less of that of the first common flow channel 22. Herein, a flow channel resistance of the second integration flow channel 26 is more accurately a flow channel resistance of the second integration flow channel 26 in a range where the first common flow channel 22 is linked thereto.

A structure is provided in such a manner that the first integration flow channel 24 is arranged on one end of the second flow channel member 6 in a transverse direction thereof, the second integration flow channel 26 is arranged on the other end of the second flow channel member 6 in the transverse direction, and respective flow channels face a side of the first flow channel member 4 and are linked to the second common flow channel 20 and the first common flow channel 22, respectively. Such a structure is provided so that it is possible to increase cross-sectional areas of the first integration flow channel 24 and the second integration flow channel 26 and it is possible to decrease flow channel resistances thereof. Furthermore, such a structure is provided so that an outer periphery of the first flow channel member 4 is fixed by the second flow channel member 6 and it is possible to increase a rigidity thereof. Moreover, such a structure is provided so that it is possible to provide the through-hole 6*a* to pass the signal transmission parts 60.

On a bottom surface of the second flow channel member 6, a groove that composes the first integration flow channel 24 and a groove that composes the second integration flow channel 26 are arranged. A groove that composes the first integration flow channel 24 on the second flow channel member 6 is linked to an opening 20*b* of a second common flow channel 20 where a part of a bottom surface thereof is blocked with a top surface of the flow channel member 4 and other parts of the bottom surface are arranged on the top surface of the flow channel member 4, so as to provide the first integration flow channel 24. A groove that composes the second integration flow channel 26 on the second flow channel member 6 is linked to an opening 22*b* of a first common flow channel 22 where a part of a bottom surface thereof is blocked with a top surface of the flow channel member 4 and other parts of the bottom surface are arranged on the top surface of the flow channel member 4, so as to provide the second integration flow channel 26.

The first integration flow channel 24 and the second integration flow channel 26 may be provided with dampers so as to stabilize supply or emission of a liquid against a variation in a discharge amount of such a liquid. Furthermore, a filter may be provided inside the first integration flow channel 24 and the second integration flow channel 26 or between the second common flow channel 20 or the first common flow channel 22 so as to prevent a foreign substance or a gas bubble from readily penetrating into the first flow channel member 4.

A top surface of the second flow channel member 6 is blocked with a housing made of a metal or the like. The signal transmission parts 60 are electrically connected to, for example, a wiring substrate that is housed in a housing. A wiring substrate and the control part 88 are electrically connected by a cable or the like. A driver IC that drives the displacement element 50 may be packaged in the signal transmission part 60. A driver IC contacts a housing made of a metal or a member that readily transfers heat to such a housing, so that it is possible to release heat that is generated in the driver IC to an outside.

Arrangement is provided in such a manner that the piezoelectric actuator substrate 40 that includes displacement elements 50 is joined to the pressurizing chamber surface 4-1 that is a top surface of the first flow channel member 4 and each displacement element 50 is positioned on a pressurizing chamber 10. The piezoelectric actuator substrate 40 occupies a region with a shape that is substantially identical to that of a pressurizing chamber group that is composed of pressurizing chambers 10. Furthermore, an opening of each pressurizing chamber 10 is closed by joining the piezoelectric actuator substrate 40 to the pressurizing chamber surface 4-1 of the flow channel member 4. The piezoelectric actuator substrate 40 is of a rectangular shape that is longer in a direction that is identical to that of the head body 2*a*.

A signal transmission part 60 that supplies a signal to each displacement element 50 is connected to the piezoelectric actuator substrate 40. The through-hole 6*a* that penetrates the second flow channel member 6 upwardly and downwardly are provided at a center thereof and the signal transmission parts 60 are electrically linked to the control part 88 through the through-hole 6*a*. If the signal transmission part 60 is shaped so as to extend in a transverse direction from an end of one longer side of the piezoelectric actuator substrate 40 to an end of the other longer side and wirings that are arranged on the signal transmission part 60 extend in a transverse direction and are aligned in a longitudinal direction, it is possible to increase a distance between such wirings. Separate electrodes 44 are respectively arranged at positions that face respective pressurizing chambers 10 on a top surface of the piezoelectric actuator substrate 40.

The flow channel member 4 has a lamination structure where a plurality of plates are laminated. A plate 4*a* is arranged on a side of the pressurizing chamber surface 4-1 of the flow channel member 4 and plates 4*b* to 4*l* are sequentially laminated under the plate 4*a*. Additionally, the plate 4*a* that holes are formed in and that composes a side wall of a pressurizing chamber 10 may be referred to as a cavity plate 4*a*, plates 4*e*, 4*f*, 4*i*, and 4*j* that holes are formed in and that compose side walls of common flow channels may be referred to as manifold plates 4*e*, 4*f*, 4*i*, and 4*j*, and a plate 4*l* where the discharge holes 8 are opened may be referred to as a nozzle plate 4*l*. A lot of holes or grooves are formed on each plate. For example, it is possible to fabricate each plate from a metal and form holes or grooves by etching. A thickness of each plate is approximately 10 to 300 μm, so that it is possible to improve a formation accuracy of a hole to be formed. Respective plates are aligned and laminated in such a manner that such holes are communicated with one another so as to compose flow channels such as the second common flow channels 20.

On the pressurizing chamber surface 4-1 of the flow channel member 4 with a flat plate shape, the pressurizing chamber body 10*a* is opened and the piezoelectric actuator substrate 40 is joined thereto. Furthermore, on the pressurizing chamber surface 4-1, an opening 20*b* to supply a liquid to the second common flow channel 20 and an opening 22*b* to recover such a liquid from the first common flow channel 22 are opened. On the discharge hole surface 4-2 of the flow channel member 4 that is a surface on an opposite side of the pressurizing chamber surface 4-1, the discharge holes 8 are opened.

For a structure that discharges a liquid, a pressurizing chamber 10 and a discharge hole 8 are provided. The pressurizing chamber 10 includes a pressurizing chamber body 10*a* and a partial flow channel 10*b*. The pressurizing chamber body 10*a* is formed on the cavity plate 4*a* and faces the displacement element 50. In a plan view, the pressurizing chamber body 10*a* is of a substantially elliptical shape that is longer in a second direction. Additionally, an elliptical shape does not have to be provided and a rectangular shape or a circular shape may be provided.

The partial flow channel 10*b* links the pressurizing chamber body 10*a* and the discharge hole 8. The partial flow channel 10*b* is formed in such a manner that holes that are formed on the plates 4*b* to 4*k* are overlapped. On a lower end of the partial flow channel 10*b*, a part other than the discharge holes 8 is blocked with the nozzle plate 4*l*. Hence, the partial flow channel 10*b* extends in a thickness direction of a flow channel member 4.

The second flow channel 12 links the pressurizing chamber body 10*a* and the second common flow channel 20. The second flow channel 12 includes a hole with a circular shape that penetrates the plate 4*b*, an elongated penetrating groove that extends in a planar direction on the plate 4*c*, and a hole with a circular shape that penetrates the plate 4*d*.

The first flow channel 14 links the partial flow channel 10*b* and the first common flow channel 22. The first flow channel 14 has a first connection flow channel 14*b* that connects the first common flow channel 22 and a plurality of separate flow channels 14*a* that are linked to one pressurizing chamber 10. In other words, the first flow channel 14 has a first separate flow channel 14*a* that is only linked to one pressurizing chamber 10A, a first separate flow channel 14*a* that is only linked to another pressurizing chamber 10B, and a first connection flow channel 14*b* that connects such two first separate flow channels 14*a* and the first common flow channel 22. In FIG. 4, the two first separate flow channels 14*a* that are respectively linked to the two pressurizing chambers 10A, 10B are joined (or linked) and the first connection flow channel 14*b* is linked to the first common flow channel 22.

One first common flow channel 22 has a plurality of sets 15 that are composed of the first connection flow channel 14*b* and the plurality of first separate flow channels 14*a*. A "set" that is herein referred to is one first flow channel 14. A plurality of first connection flow channel 14*b* are linked to one first common flow channel 22. The number of a first connection flow channel(s) 14*b* that is/are linked to one first common flow channel 22 is half of the number of the pressurizing chambers 10 that are linked to one first common flow channel 22. The plurality of first separate flow channels 14*a* are bundled to the first connection flow channel 14*b* and subsequently linked to the first common flow channel 22, so that a space efficiency is improved. Additionally, the number of the first separate flow channels 14*a* that are linked to the first connection flow channel 14*b* may be three or greater.

On the second common flow channel 20, holes that are formed on the plates 4*e*, 4*f* are overlapped and further an upper side thereof and a lower side thereof are blocked by the plate 4*d* and the plate 4*g*. On the first common flow channel 22, holes that are formed on the plates 4*i*, 4*j* are overlapped and further an upper side thereof and a lower side thereof are blocked by and composed of the plate 4*h* and the plate 4*k*.

As summarized for a flow of a liquid, a liquid that is supplied to the first integration flow channel 24 sequentially passes through the second common flow channel 20 and the second flow channel 12 and enters the pressurizing chamber 10 and a part of such a liquid is discharged from the discharge hole 8. A liquid that is not discharged therefrom passes through the first flow channel 14, enters the first common flow channel 22, subsequently enters the second integration flow channel 26, and is emitted to an outside of the head body 2*a*.

The piezoelectric actuator substrate 40 has a laminate structure that is composed of two piezoelectric ceramic layers 40*a*, 40*b* that are piezoelectric bodies. Each of the piezoelectric ceramic layers 40*a*, 40*b* has a thickness of approximately 20 μm. That is, a thickness from a top surface of the piezoelectric ceramic layer 40*a* of the piezoelectric actuator substrate 40 to a bottom surface of the piezoelectric ceramic layer 40*b* thereof is approximately 40 μm. A ratio of thicknesses of the piezoelectric ceramic layer 40*a* and the piezoelectric ceramic layer 40*b* is 3:7 to 7:3, preferably, 4:6 to 6:4.

Any layer of the piezoelectric ceramic layers 40*a*, 40*b* extends so as to step over the plurality of pressurizing chambers 10. The piezoelectric ceramic layer 40*a*, 40*b* is composed of, for example, a ceramic material such as a lead zirconate titanate (PZT) type, a $NaNbO_3$ type, a $BaTiO_3$ type, a $(BiNa)NbO_3$ type, or a $BiNaNb_5O_{15}$ type that has a ferroelectricity. Additionally, the piezoelectric ceramic layer 40*b* serves as a vibration plate in the present embodiment and piezoelectric deformation thereof is not directly caused. For a vibration plate, a ceramic, a metal plate, or the like that does not have a piezoelectricity may be used instead of the piezoelectric ceramic layer 40*b*.

The piezoelectric actuator substrate 40 has a common electrode 42 that is composed of a metal material such as an Ag—Pd type and a separate electrode 44 that is composed of a metal material such as an Au type. A thickness of the common electrode 42 is approximately 2 μm and a thickness of the separate electrode 44 is approximately 1 μm.

Respective separate electrodes 44 are respectively arranged at positions that face respective pressurizing chamber bodies 10*a* on a top surface of the piezoelectric actuator substrate 40. A separate electrode 44 has a separate electrode body 44*a* and an extraction electrode 44*b*. The separate electrode body 44*a* has a planar shape that is one size smaller than that of a pressurizing chamber body 10*a* and a shape that is substantially similar to that of the pressurizing chamber body 10*a*. The extraction electrode 44*b* is drawn from the separate electrode body 44*a*. A connection electrode 46 is formed on a part that is drawn to an outside of a region that faces the pressurizing chamber 10, on an end of the extraction electrode 44*b*. The connection electrode 46 is formed of, for example, an electrically conductive resin that includes an electrically conductive particle such as a silver particle, with a thickness of approximately 5 to 200 μm. The connection electrode 46 is electrically joined to electrodes that are provided on the signal transmission part 60.

A driving signal is supplied from the control part 88 to the separate electrode 44 through the signal transmission part 60. A driving signal is supplied at a constant period of time, in synchronization with a conveyance speed of a printing paper sheet P.

The common electrode 42 is formed over a substantially whole surface of a region between the piezoelectric ceramic layer 40*a* and the piezoelectric ceramic layer 40*b* in a surface direction. That is, the common electrode 42 extends so as to cover all of pressurizing chambers 10 in a region that faces the piezoelectric actuator substrate 40. The common electrode 42 is linked to a (non-illustrated) surface electrode that is formed on the piezoelectric ceramic layer 40*a* at a position where an electrode group that is composed of the separate electrodes 44 is avoided, via a penetrating conductor that is formed so as to penetrate the piezoelectric ceramic layer 40*a*. Furthermore, the common electrode 42 is grounded via a surface electrode and held at a ground potential. A surface electrode is directly or indirectly connected to the control part 88 similarly to the separate electrode 44.

A part that is interposed between the separate electrode 44 and the common electrode 42 for the piezoelectric ceramic layer 40*a* is polarized in a thickness direction thereof and is a displacement element 50 with a unimorph structure that is displaced as a voltage is applied to the separate electrode 44. More specifically, when the separate electrode 44 is provided at an electric potential that is different from that of the common electrode 42 so that an electric filed is applied to the piezoelectric ceramic layer 40*a* in a polarization direction thereof, a part where such an electric filed is applied serves as an active part that is distorted by a piezoelectric effect. In such a configuration, as the separate electrode 44 is provided at a predetermined positive or negative potential relative to that of the common electrode 42 by the control part in such a manner that an electric field and a polarization are provided in an identical direction, a part (an active part) that is interposed between electrodes for the piezoelectric ceramic layer 40*a* is contracted in a surface direction. On the other hand, the piezoelectric ceramic layer 40*b* that is an inactive layer is not influenced by an electric field, and hence, is not spontaneously contracted but suppresses deformation of an active part. As a result, a difference in distortion in a polarization direction is caused between the piezoelectric ceramic layer 40*a* and the piezoelectric ceramic layer 40*b*, so that the piezoelectric ceramic layer 40*b* is deformed (unimorph-deformed) to protrude toward a side of the pressurizing chambers 10.

Next, an operation to discharge a liquid will be explained. The displacement element 50 is driven (displaced) by a driving signal that is supplied to the separate electrode 44 via a driver IC or the like in control from the control part 88. In the present embodiment, although it is possible to discharge a liquid according to a variety of driving signals, a so-called push-pull driving method will be explained herein.

While the separate electrode 44 is preliminarily provided at a potential that is higher than that of the common electrode 42 (that will be referred to as a higher potential below), the separate electrode 44 is once provided at a potential that is identical to that of the common electrode 42 (that will be referred to as a lower potential below) every time a request of discharging is provided, and subsequently, such a higher potential is provided at a predetermined timing again. Thereby, at a timing when the separate electrode 44 is provided at a lower potential, the piezoelectric ceramic layers 40*a*, 40*b* (start to) return to original (flat) shapes and a volume of the pressurizing chamber 10 is increased as compared with an initial state (a state where potentials of both electrodes are different). Thereby, a negative pressure is applied to a liquid in the pressurizing chamber 10. Accordingly, a liquid in the pressurizing chamber 10 starts to vibrate at a period of time of a natural vibration thereof. Specifically, a volume of the pressurizing chamber 10 first starts to increase and a negative pressure is generally decreased. Then, a volume of the pressurizing chamber 10 is maximized and a pressure thereof is substantially zero. Then, a volume of the pressurizing chamber 10 starts to decrease and a pressure thereof increases. Subsequently, at a timing when a pressure is substantially maximum, the separate electrode 44 is provided at a higher potential. Accordingly, vibration that is first applied and vibration that is then applied overlap and a greater pressure is applied to a liquid. Such a pressure propagates in the partial flow channel 10*b* and a liquid is discharged from the discharge hole 8.

That is, a pulsed driving signal that provides a lower potential for a certain period of time, with reference to a higher potential, is supplied to the separate electrode 44, so that it is possible to discharge a liquid drop. If such a pulse width is an Acoustic Length (AL) that is a half period of time of a period of time of natural vibration of a liquid in the pressurizing chamber 10, it is possible to maximize a discharge speed and a discharge amount of a liquid in principle. A period of time of natural vibration of a liquid in the pressurizing chamber 10 is greatly influenced by a physical property of such a liquid or a phase of the pressurizing chamber 10, and otherwise, is also influenced by a physical property of the piezoelectric actuator substrate 40 or a property of a flow channel that is linked to the pressurizing chamber 10.

Herein, the second common flow channel 20 is connected to the pressurizing chamber body 10*a* by the second flow channel 12 and the first common flow channel 22 is connected by the first flow channel 14, so that a liquid is discharged and recovered and printing is executed. In a case where an image to be printed is of a high image quality, a discharge frequency is different for each pressurizing chamber. Herein, a pressurizing chamber where a continuous displacement is needed may cause an insufficient supply from the second common flow channel 20 so as to decrease a discharge amount. Furthermore, a pressurizing chamber with a less discharge frequency may cause an insufficient recovery from the first common flow channel 22 so as to increase a discharge amount.

On the other hand, in the liquid discharge head 2 according to the present embodiment, the first flow channel 14 has the first connection flow channel 14*b* that connects the first common flow channel 22 and the plurality of first separate flow channels 14*a* that are linked to one pressurizing chamber 10, and one first common flow channel 22 has the plurality of sets 15 that are composed of the first connection flow channel 14*b* and the plurality of first separate flow channels 14*a*. That is, as illustrated in FIG. 4, the plurality of sets 15 that are composed of the first connection flow channel 14*b* that connects a first separate flow channel 14*a* that is linked to the pressurizing chamber 10A and a first separate flow channel 14*a* that is linked to the pressurizing chamber 10B are connected to the first common flow channel 22.

Thereby, for example, even in a case where a discharge frequency of the pressurizing chamber 10A is small, a discharge amount is prevented from being readily increased.

Specifically, as discharging from the pressurizing chamber 10B is executed, a liquid that is not discharged flows into the first connection flow channel 14*b* through the first separate flow channel 14*a* that is linked to the pressurizing chamber 10B. Then, as recovery thereof is executed by the first common flow channel 22 through the first connection flow channel 14*b*, a part of a liquid on the first separate flow channel 14*a* that is linked to the pressurizing chamber 10A also flows into the first connection flow channel 14*b*, according to a viscosity of such a liquid. As a result, a part of a liquid in the pressurizing chamber 10A is recovered, and a discharge amount of a liquid that is discharged in a case where discharging from the pressurizing chamber 10A is then executed is prevented from being readily increased. Thereby, it is possible to execute printing with a high image quality.

Furthermore, one first common flow channel 22 has the plurality of sets 15 that are composed of the first connection flow channel 14*b* and the plurality of first separate flow channels 14*a*, so that it is possible to have a plurality of recovery routes from each set 15 to the first common flow channel 22, and hence, it is also possible to execute recovery of a liquid smoothly.

Herein, the second common flow channel 20 supplies a liquid to be discharged, and hence, a cross-sectional area thereof is preferably large. In order to flow a circulating liquid, a cross-sectional area of the first common flow channel 22 is also preferably large to a certain degree. On the other hand, as a cross-sectional area of a common flow channel is increased, a width of the head body 2*a* in a transverse direction thereof is increased and a range where the discharge holes 8 are distributed in such a transverse direction is also increased. As a distribution range of the discharge holes 8 in a transverse direction is increased, degradation of a printing accuracy is undesirably increased when a placement angle of the liquid discharge head 2 is displaced so as to rotate in a planar direction.

In order to increase a cross-sectional area of a common flow channel without greatly increasing a width of the head body 2*a* in a transverse direction thereof, it is sufficient to decrease an arrangement gap between common flow channels. If a space efficiency of arrangement of a flow channel between common flow channels is improved, it is possible to decrease an arrangement gap between common flow channels. The first flow channel 14 is a flow channel that is connected to a neighborhood of the discharge hole 8 of the pressurizing chamber 10, and hence, if a space efficiency of arrangement of the first flow channel 14 is improved, it is possible to decrease an arrangement gap between common flow channels.

In order to decrease a difference between discharge characteristics of liquid drops that are discharged from respective discharge holes 8, a difference between flow channel characteristics of first flow channels 14 is preferably small. Accordingly, cross-sectional areas and lengths of the first flow channels 14 are preferably substantially identical in a design thereof. Furthermore, it is desirable for the first flow channel 14 to have a flow channel characteristic that is suitable for discharging where there are a cross-sectional area and a length that are suitable for providing such a flow channel characteristic. If a space efficiency is simply improved, for example, a flow channel that provides linear linking at a minimum distance may be provided but it is difficult for such a flow channel to have a flow channel characteristic as described above.

On the other hand, in the liquid discharge head 2 according to the present embodiment, a connection position to the pressurizing chamber 10 on the first flow channel 14 may be closer to the discharge hole 8 than a connection position to the pressurizing chamber 10 on the second flow channel 12.

Thereby, it is possible to decrease a space that is needed for arrangement of a flow channel than providing respective completely separate flow channels.

Furthermore, in a case where two or more discharge hole lines 9A are arranged on one side of one first common flow channel 22 as the present embodiment, a flow channel length of the first flow channel 14 that is linked to a discharge hole line 9A that is far away from the first common flow channel 22 is increased so as to be linked to the first common flow channel 22. Although a flow channel length of the first flow channel 14 that is linked to a discharge hole line 9A that is close to the first common flow channel 22 may be decreased if simple linking is executed, if a flow channel length is provided that is substantially identical to that of the first flow channel 14 that is linked to a discharge hole line 9A that is far away from the first common flow channel 22 in order to match flow channel characteristics thereof, it is preferable to execute bundling to the first connection flow channel 14*b* and subsequent linking to the first common flow channel 22 in order to arrange such a long flow channel efficiently.

Furthermore, in the liquid discharge head 2 according to the present embodiment, the first connection flow channel 14*b* may be longer than the first separate flow channel 14*a*.

A part of a pressure to execute discharging is transmitted from the plurality of pressurizing chambers 10 to a liquid in the first common flow channel 22, so that a complicated pressure oscillation is caused. A part of such a pressure oscillation is transmitted to a pressurizing chamber 10, so that subsequent discharging may be influenced thereby. If pressures from two pressurizing chambers 10 are synthesized on the connection flow channel 14*b* before being transmitted to the first common flow channel 22 and subsequently transmitted thereto, it is possible to reduce a complexity of pressure oscillation in the first common flow channel 22 and it is possible to decrease an influence that is provided on subsequent discharging. Additionally, if a completely cylindrical flow channel is filled with a Newtonian fluid, respective pressure waves are transmitted independently, but if a practical flow channel shape and an actual liquid are provided, such pressures influence one another. The first connection flow channel 14*b* is preferably longer than the first separate flow channel 14*a* so as to accelerate pressure synthesis.

Herein, a pressure that is produced in one pressurizing chamber 10 at a time of discharging may pass through the first separate flow channel 14*a* that is linked to such a pressurizing chamber 10 and subsequently be transmitted to another pressurizing chamber 10 through the first separate flow channel 14*a* that is linked to the other pressurizing chamber 10.

In the liquid discharge head 2 according to the present embodiment, a flow channel resistance of the first separate flow channel 14*a* may be greater than a flow channel resistance of the first connection flow channel 14*b*.

Thereby, as illustrated in FIG. 4, a pressure that is produced in the pressurizing chamber 10A at a time of discharging is not readily transmitted to the first separate flow channel 14*a*. As a result, a pressure is not readily propagated to the pressurizing chamber 10B in an identical set 15.

As illustrated in FIG. 3, the first common flow channels 22 extend in a first direction and are aligned in a second direction. Then, a region between the first common flow channels 22 that are neighbored in a second direction is a first region E1. Furthermore, the second common flow channels 20 extend in a first direction and are aligned in a second direction. Then, a region between the second common flow channels 20 that are neighbored in a second direction is a second region E2.

Furthermore, in the liquid discharge head 2 according to the present embodiment, a first flow channel 14 that is linked to discharge holes 8 that are arranged in the first region E1 between two first common flow channels 22 may be arranged so as to fall within the first region E1 in a plan view.

Thereby, the plurality of first separate flow channels 14*a* are bundled so as to provide the first connection flow channel 14*b* and subsequently are linked to the first common flow channel 22, so that it is possible to improve a space efficiency.

Furthermore, in the liquid discharge head 2 according to the present embodiment, a first flow channel 14 that is linked to discharge holes 8 that are arranged in the second region E2 between two second common flow channels 20 may be arranged so as to fall within the second region E2 in a plan view.

Thereby, the plurality of first separate flow channels 14*a* are bundled so as to provide the first connection flow channel 14*b* and subsequently are linked to the first common flow channel 22, so that it is possible to improve a space efficiency.

Furthermore, in the liquid discharge head 2 according to the present embodiment, the first common flow channel 22 and the first flow channel 14 may be arranged so as to be closer to the discharge hole surface 4-2 where the discharge holes 8 are opened than the second common flow channel 20.

Thereby, the plurality of first separate flow channels 14*a* are bundled so as to provide the first connection flow channel 14*b* and subsequently are linked to the first common flow channel 22, so that it is possible to improve a space efficiency and it is possible to arrange the first common flow channel 22 and the first flow channel 14 so as to be closer to the discharge hole surface 4-2 than the second common flow channel 20. Thereby, it is possible to arrange the first flow channel 14 so as to be closer to the discharge hole surface 4-2 than the second common flow channel 20 and it is possible to link the first flow channel 14 so as to be close to the discharge hole 8 of the partial flow channel 10*b*. As a result, a liquid near the discharge hole 8 is prevented from being readily retained.

The first separate flow channel 14*a* includes a first site 14*aa* and a second site 14*ab*. The first site 14*aa* is directly linked to the pressurizing chamber 10. The second site 14*ab* links the first site 14*aa* and the first connection flow channel 14*b*. The first site 14*a* is configured to block holes or grooves that are arranged on one plate 4*k* with planar parts of other plates 4*j*, 4*l*. The second site 14*ab* is configured to block holes or grooves that are arranged on the plate 4*j* that is different from the plate 4*k* that holes or grooves are arranged in and that composes the first site 14*aa*, with planar parts of other plates 4*i*, 4*k*.

Furthermore, in the liquid discharge head 2 according to the present embodiment, a flow channel resistance per unit length of the first site 14*aa* may be greater than a flow channel resistance per unit length of the second site 14*ab*. Thereby, a pressure from the pressurizing chamber 10 is prevented from being readily transmitted to the first flow channel 14 and pressure oscillation in the pressurizing chamber 10 is prevented from being readily complicated.

In the present liquid discharge head 2, the first site 14*aa* is directly connected to the pressurizing chamber 10, so that reflection of a pressure wave is mainly caused at such a connection part. Hence, pressure oscillation in the pressurizing chamber 10 is comparatively simple and subsequent discharging is comparatively readily executed so as to correspond to such pressure oscillation. As a part with a high flow channel resistance is provided in a middle of the first separate flow channel 14*a*, reflection of a large pressure wave is caused at two points such as a connection part between the pressurizing chamber 10 and the first separate flow channel 14*a* and a part with a high flow channel resistance, so that pressure oscillation in the pressurizing chamber 10 is readily complicated, it is difficult to execute subsequent discharging by taking such pressure oscillation into consideration, and a discharge characteristic readily varies according to the pressure oscillation.

Furthermore, in the liquid discharge head 2 according to the present embodiment, a thickness of a plate that holes or grooves are arranged in and that composes the second site 14*ab* may be greater than a thickness of a plate that holes or grooves are arranged in and that composes the first site 14*aa*. Specifically, the plate 4*j* is thicker than the plate 4*k*.

According to such a configuration, a needed flow channel characteristic such as a flow channel resistance is satisfied by the first site 14*aa* and both spots are linked that have to be linked are linked by the second site 14*ab* with a cross-sectional area that is greater than that of the first site 14*aa* and a less influence of a flow channel characteristic that is occupied by the first separate flow channel 14*a*, so that it is possible to provide a needed flow channel characteristic to the first separate flow channel 14*a* and link both spots that have to be linked.

If the plate 4*j* is a plate that holes or grooves are arranged in and that composes the first common flow channels 22, it is possible to decrease the number of needed plates. Furthermore, the plate 4*k* is thinner than the plate 4*j*, so that it is possible to decrease an AL of the pressurizing chamber 10 and it is possible to drive the liquid discharge head 2 at a short period of time.

Figure 6:
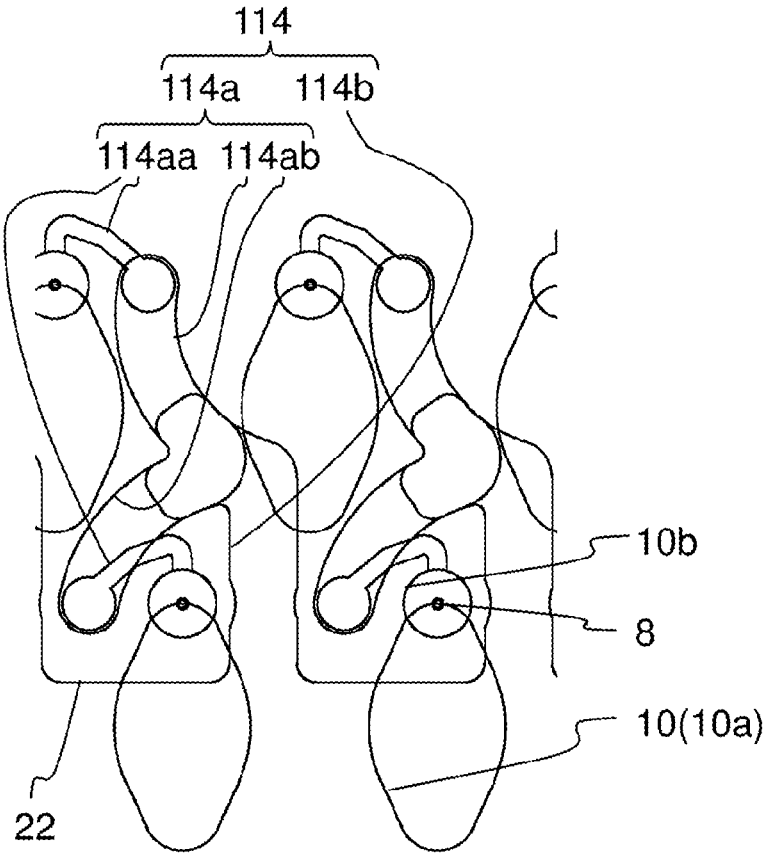
FIG. 6 is a plan view of a part of a flow channel of another liquid discharge head in the present disclosure.
Figure 7:
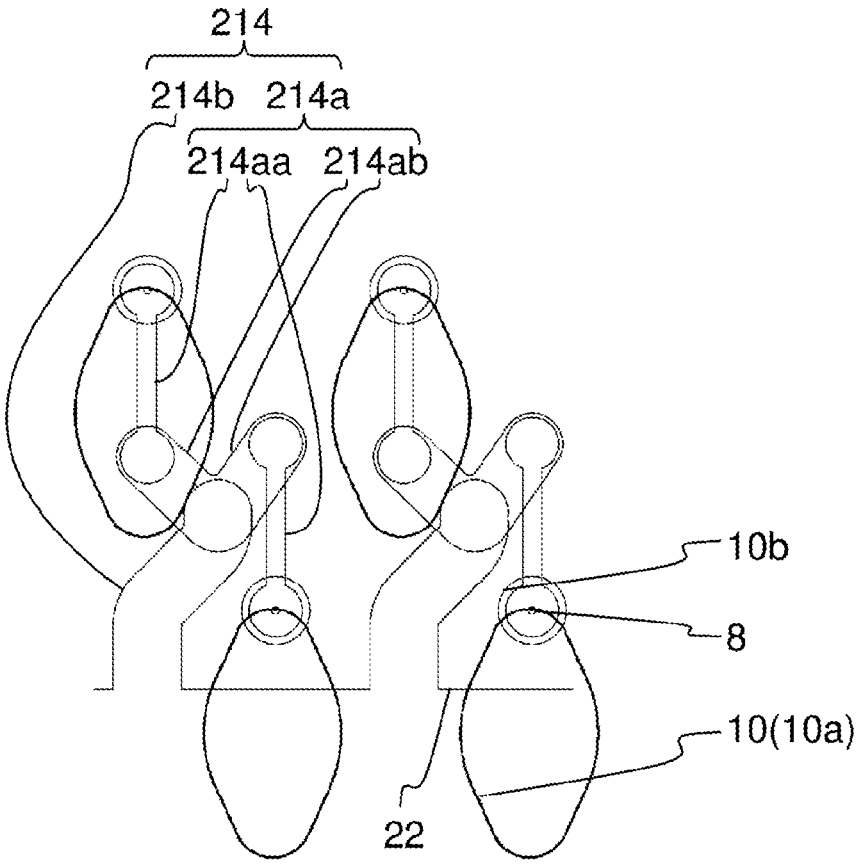
FIG. 7 is a plan view of a part of a flow channel of another liquid discharge head in the present disclosure.

FIG. 6 and FIG. 7 are plan views of a part of a flow channel member of a liquid discharge head according to another embodiment of the present disclosure. A configuration other than a first flow channel is similar to that of the liquid discharge head 2 as illustrated in FIGS. 2 to 5, so that an explanation thereof will be omitted. A first common flow channel 22, a pressurizing chamber 10, and the like will be provided with identical signs in such figures and an explanation thereof will be omitted.

A first flow channel 114 in FIG. 6 includes a first separate flow channel 114*a* that is linked to only one pressurizing chamber 10 and a first connection flow channel 114*b*. One first connection flow channel 114*b* is liked to two first separate flow channels 114*a*.

Furthermore, in the liquid discharge head 2 according to the present embodiment, an angle between both first separate flow channels 114*a* at a connection point where the two first separate flow channels 114*a* and the first connection flow channel 114*b* are connected is greater than an angle between the first separate flow channels 114*a* and the first connection flow channel 114*b*. Specifically, an angle between both first separate flow channels 114*a* is approximately 80 degrees. As illustrated in FIG. 6, the first connection flow channel 114*b* is linked to the first separate flow channel 114*a* so as to rise, so that an angle between the first separate flow channel 114*a* and the first connection flow channel 114*b* is substantially 90 degrees. Therefore, a magnitude relationship between such angles is provided as described above.

A magnitude relationship between such angles is provided, so that a pressure that is transmitted from one first separate flow channel 114*a* is transmitted to the first connection flow channel 114*b* more readily than another first separate flow channel 114*a*, and hence, it is possible to decrease pressure propagation that is caused between both pressurizing chambers 10 that are linked via the first flow channel 114.

Additionally, although both of the two first separate flow channels 114*a* satisfy a condition as described above in the present embodiment, satisfaction thereof may be provided by only one first separate flow channel 114*a*. If satisfaction thereof is provided by all of separate flow channels 114*a* that are linked to the first connection flow channel 114*b*, it is possible to provide an effect as described above for all of the separate flow channels 114*a*.

A first flow channel 214 in FIG. 7 includes a first separate flow channel 214*a* and a first connection flow channel 214*b*. One first connection flow channel 214*b* is linked to two first separate flow channels 214*a*.

Furthermore, in the liquid discharge head 2 according to the present embodiment, an angle between both first separate flow channels 214*a* at a connection point where the two first separate flow channels 214*a* and the first connection flow channel 214*b* are connected is greater than an angle between the first separate flow channels 214*a* and the first connection flow channel 214*b*. Specifically, an angle between both first separate flow channels 214*a* is approximately 80 degrees. As illustrated in FIG. 7, the first connection flow channel 214*b* is linked to the first separate flow channel 214*a* so as to rise, so that an angle between the first separate flow channel 214*a* and the first connection flow channel 214*b* is substantially 90 degrees. Therefore, a magnitude relationship between such angles is provided as described above.

A magnitude relationship between such angles is provided, so that a pressure that is transmitted from one first separate flow channel 214*a* is transmitted to the first connection flow channel 214*b* more readily than another first separate flow channel 214*a*, and hence, it is possible to decrease pressure propagation that is caused between both pressurizing chambers 10 that are linked via the first flow channel 214.

Figure 8:
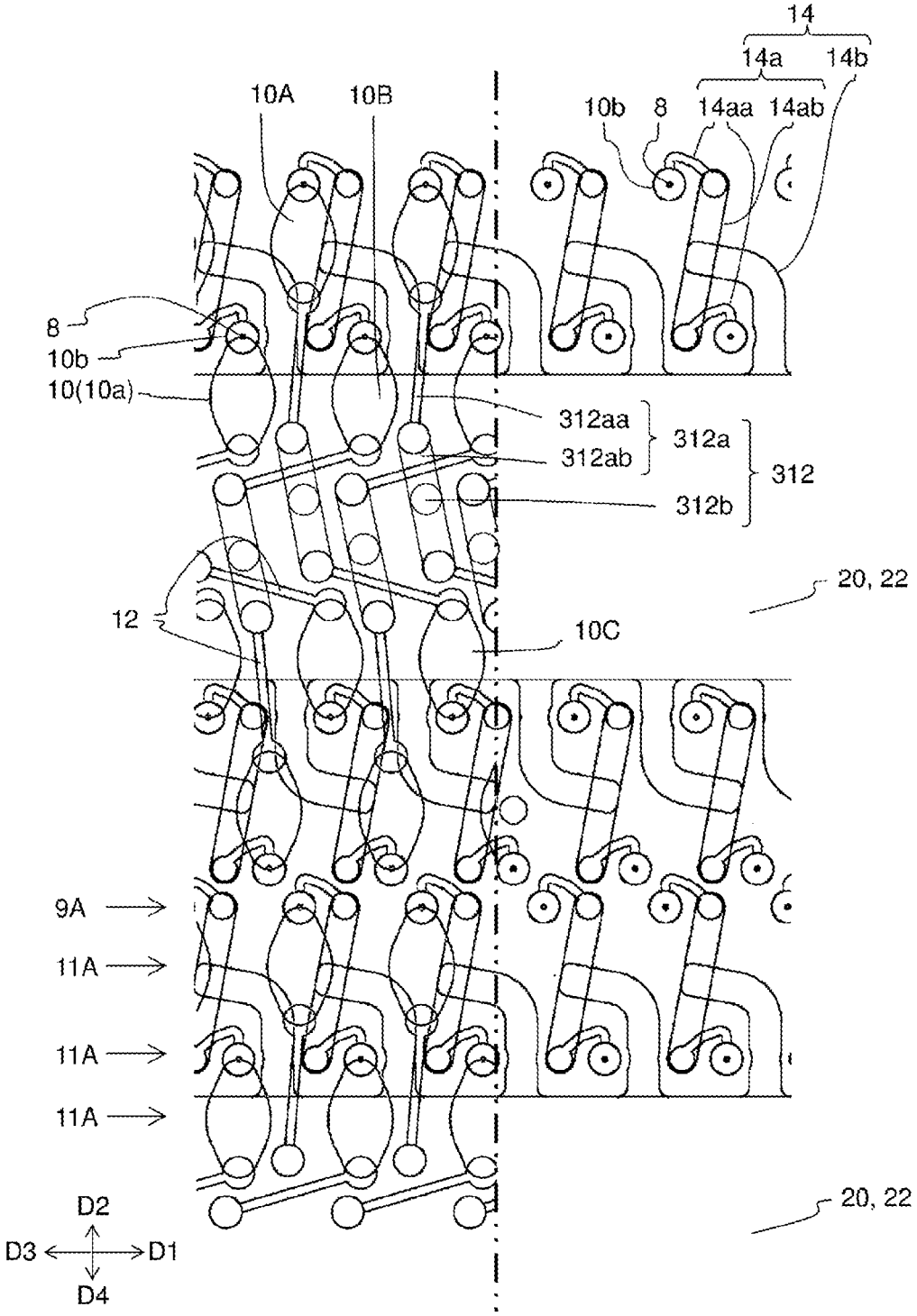
FIG. 8 is an enlarged plan view of another liquid discharge head in the present disclosure.

FIG. 8 illustrates another embodiment of the present disclosure and is a plan view that corresponds to FIG. 4. Additionally, a configuration of a second flow channel 312 is different from that of the embodiment as illustrated in FIG. 4.

Pressurizing chambers 10 include pressurizing chambers 10A to 10C. Basic configurations of the pressurizing chambers 10A to 10C are identical to one another, so that only a relationship between the pressurizing chamber 10A and the second flow channel 312 will be explained.

The second flow channel 312 includes a second separate flow channel 312*a* and a second connection flow channel 312*b*. The second separate flow channel 312*a* extends from the pressurizing chamber 10A in a fourth direction. The second separate flow channel 312*a* includes a first site 312*aa* and a second site 312*ab*. The first site 312*aa* extends from an underside of the pressurizing chamber 10A in a fourth direction. In a plan view, the first site 312*aa* is thinner than a hole for flowing downward from the pressurizing chamber 10A. The second site 312*ab* is connected to the first site 312*aa*. In a plan view, a width of the second site 312*ab* is greater than a width of the first site 312*aa*.

The first site 312*aa* and the second site 312*ab* are formed on an identical plate. In other words, a groove with a smaller width and a groove with a larger width are formed on such an identical plate where the first site 312*aa* is composed of such a groove with a smaller width and the second site 312*ab* is formed by such a grove with a larger width. Thus, the first site 312*aa* and the second site 312*ab* are formed on an identical plate, so that a thickness of the first flow channel member 4 is prevented from being readily increased.

The second connection flow channel 312*b* is positioned under the second site 312*ab*, and in a plan view, is positioned at a central part of the second site 312*ab* in a fourth direction. The second connection flow channel 312*b* is formed by a hole and connects the second site 312*ab* and a second common flow channel 20. The second connection flow channel 312*b* connects the second site 312*ab* of the second separate flow channel 312*a* for the pressurizing chamber 10A and the second site 312*ab* of the second separate flow channel 312*a* for the pressurizing chamber 10B, so as to form a set thereof.

In the present embodiment, the second flow channel 312 has the second connection flow channel 312*b* that connects the second common flow channel 20 and a plurality of second separate flow channels 312*a* that are linked to one pressurizing chamber 10 where one second common flow channel 20 has a plurality of sets that are composed of the second connection flow channel 312*b* and the plurality of second separate flow channels 312*a*.

Thereby, as described above, even in a case where a discharge frequency is different for each pressurizing chamber 10, for example, even in a case where a discharge frequency of the pressurizing chamber 10A is large, if a discharge frequency of the pressurizing chamber 10B is small, a following matter is caused at a time of discharging for the pressurizing chamber 10A.

As discharging from the pressurizing chamber 10A is executed, a liquid that is insufficient according to discharging flows into a second separate flow channel 312*a* that is linked to the pressurizing chamber 10B from the second common flow channel through the second connection flow channel 312*b*. Herein, even in a case where a small amount of a liquid is supplied from the second connection flow channel 312*b* to the second separate flow channel 312*a*, a part of a liquid on the first separate flow channel 14*a* that is linked to the pressurizing chamber 10A flows on the second connection flow channel 312*b*, according to a viscosity of such a liquid. As a result, a sufficient amount of a liquid is supplied to the pressurizing chamber 10A. Hence, a discharge amount of a liquid that is discharged in a case where discharging from the pressurizing chamber 10A is then executed is prevented from readily being insufficient. Thereby, it is possible to execute printing with a high image quality.

Furthermore, in the liquid discharge head 2 according to the present embodiment, the first separate flow channel 14*a* that is linked to the pressurizing chamber 10A and the first separate flow channel 14*a* that is linked to the pressurizing chamber 10B are connected by the first connection flow channel 14*b*. A second separate flow channel 312*a* that is linked to the pressurizing chamber 10A and a second separate flow channel 312*a* that is linked to the pressurizing chamber 10C are connected by the second connection flow channel 312*b*. Then, the second separate flow channel 312*a* that is linked to the pressurizing chamber 10A and the second separate flow channel 312*a* that is linked to the pressurizing chamber 10B do not have to be connected by the second connection flow channel 312*b*.

Thereby, according to a discharge frequency of another pressurizing chamber 10, supply or recovery of a liquid on the second separate flow channel 312*a* that is linked to oneself to a second separate flow channel 312*a* that is linked to the other pressurizing chamber 10 is prevented from being readily concentrated.

That is, against insufficient supply or insufficient recovery that is caused in the pressurizing chamber 10, it is possible to execute supply or recovery on first separate flow channels 14*a* and second separate flow channels 312*a* that are more than two first separate flow channels 14*a* and two second separate flow channels 312*a* to be dealt with. Thereby, it is possible to ensure a sufficient liquid that is needed against insufficient supply or insufficient recovery that is caused in the pressurizing chamber 10.

Additionally, although the first site 312*aa* and the second site 312*ab* that are formed on an identical plate are illustrated as an example, the first site 312*aa* and the second site 312*ab* may be formed on different plates.

Figure 9A:
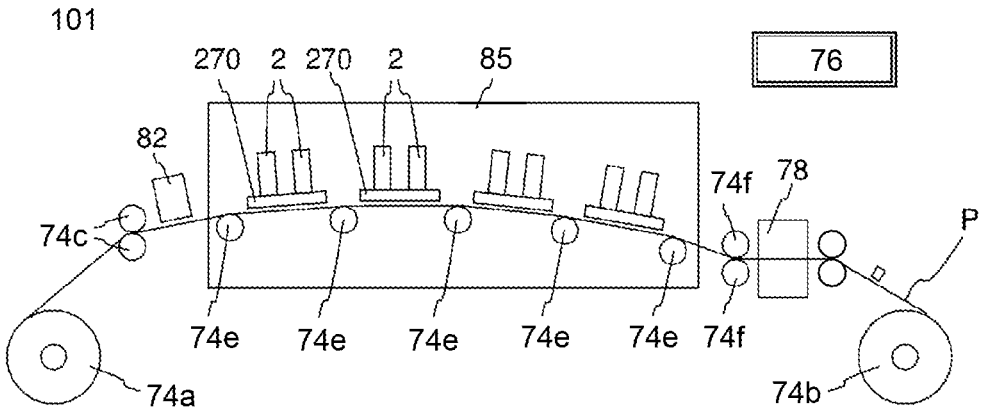
FIG. 9A is a side view that illustrates a configuration of a main part of a printer 101 according to a modification.
Figure 9B:
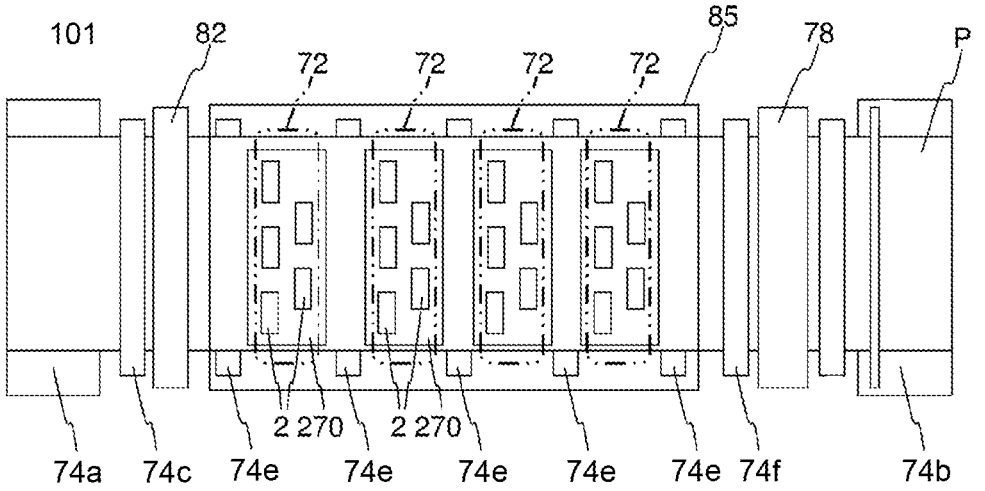
FIG. 9B is a top view of the printer 101.

FIG. 9A is a side view that illustrates a configuration of a main part of a printer 101 according to a modification. FIG. 9B is a top view of the printer 101. Hereinafter, only a part that is different from that of the printer 1 according to embodiments will be explained basically. A matter that is not particularly mentioned is similar to that of the printer 1. FIG. 1A and FIG. 1B illustrate the printer 1 where a printing paper sheet P moves from a right side on a plane of paper to a left side on the plane of paper. FIG. 9A and FIG. 9B illustrate the printer 1 where a printing paper sheet P moves from a left side on a plane of paper to a right side on the plane of paper, contrary to FIG. 1A and FIG. 1B.

The embodiments state that printing with a coating agent may be executed by the head 2. As the present modification, a coating agent may uniformly be applied by a coater 82 that is controlled by a control part 76, other than printing that is executed by a head 2. A printing paper sheet P that is sent from a conveyance roller 74*a* passes between two conveyance rollers 74*c* of a movement part and subsequently passes under the coater 82. Herein, the coater 82 applies a coating agent to a printing paper sheet P. Subsequently, a printing paper sheet P is conveyed to a downside of heads 2.

The printer 101 according to the modification has a head chamber 85 that houses the heads 2. The head chamber 85 is a space that is linked to an outside at a part such as a part where a printing paper sheet P enters or exits but is generally isolated from the outside. For the head chamber 85, (at least one of) control factors such as a temperature, a humidity, and an atmospheric pressure is/are controlled by the control part 76 or the like, as needed. In the head chamber 85, it is possible to decrease an influence of disturbance as compared with an outside thereof, so that it is possible to narrow a variation range(s) of a control factor(s) as described above, than an outside.

A head mounting frame 270 that mounts the head 2 thereon is generally provided by dividing the head mounting frame 70 according to embodiments into respective head groups 72 and is housed in the head chamber 85. In the head chamber 85, five guide rollers 74*e* are arranged where a printing paper sheet P is conveyed on the guide rollers 74*e*. The five guide rollers 74*e* are arranged in such a manner that a center thereof protrudes in a direction where the head mounting frame 270 is arranged, when viewing from a side thereof. Thereby, a printing paper sheet P that is conveyed on the five guide rollers 74*e* is of a circular arc shape when viewing from a side thereof, and a tension is applied to such a printing paper sheet P, so that the printing paper sheet P between respective guide rollers 74*e* is stretched so as to provide a planar shape. One head mounting frame 270 is arranged between two guide rollers 74*e*. Angles to place respective head mounting frames 270 are gradually changed so as to be parallel to a printing paper sheet P that is conveyed on a downside thereof.

The printer 101 according to the modification has a dryer 78. A printing paper sheet P that exits from the head chamber 85 passes between two conveyance rollers 74*f* and passes into the dryer 78. A printing paper sheet P is dried by the dryer 78, so that it is possible to prevent both printing paper sheets P that are overlapped and wound from being readily attached or prevent an undried liquid from being readily rubbed, on a conveyance roller 74*b*. In order to execute printing at a high speed, drying has to be executed quickly. In order to accelerate drying, in the dryer 78, drying may sequentially be executed by a plurality of drying methods or drying may be executed by using a plurality of drying methods in combination. For a drying method that is used in such a situation, for example, spraying with hot air, irradiation with an infrared ray, contacting a heated roller, or the like is provided. In a case where irradiation with an infrared ray is executed, an infrared ray within a particular frequency range may be applied so that it is possible to execute drying quickly while damage on a printing paper sheet P is decreased. In a case where a printing paper sheet P contacts a heated roller, such a printing paper sheet P may be conveyed along a cylindrical surface of a roller so as to increase a period of time to transfer heat. A range for conveyance along a cylindrical surface of a roller is preferably ¼ cycles or greater of the cylindrical surface of a roller, more preferably, ½ cycles or greater of the cylindrical surface of a roller. In a case where printing with an UV curable ink or the like is executed, an UV irradiation light source may be arranged instead of the dryer 78 or in addition to the dryer 78. A UV irradiation light source may be arranged between respective head mounting frames 270.

Additionally, at least one of the coater 82, the head chamber 85, and the dryer 78 may be combined with the head mounting frame 70 according to embodiments.

The printer 1 or 101 may include a cleaning part that cleans the head 2. Such a cleaning part executes, for example, wiping or capping to execute washing. Wiping is to rub a surface at a site where a liquid is discharged, for example, a discharge surface, with, for example, a flexible wiper, so that a liquid that is attached to such a surface is removed. Washing with capping is executed, for example, as follows. First, a cap is put on so as to cover a site where a liquid is discharged, for example, the discharge surface (where it is referred to as capping), so that a substantially closed space is formed by the discharge surface and such a cap. Discharging of a liquid is repeated in such a situation, so that a liquid with a viscosity that is higher than that in a standard state thereof, a foreign substance, or the like that clogs a nozzle, is removed. Capping is executed so that it is possible to prevent a liquid during washing from being readily scattered in the printer 1 or 101 and prevent a liquid from being readily attached to a printing paper sheet P or a conveyance mechanism such as a roller. The discharge surface after completing washing may further be wiped. Washing with wiping or capping may be executed in such a manner that a person manually operates a wiper or a cap that is installed in the printer 1 or 101 or may be automatically executed by the control part 76.

An additional effect(s) or variation(s) can readily be derived by a person(s) skilled in the art. Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

REFERENCE SIGNS LIST

1 . . . color ink-jet printer
2 . . . liquid discharge head
2*a* . . . head body
4 . . . (first) flow channel member
4*a* to 4*l* . . . plate
4-1 . . . pressurizing chamber surface
4-2 . . . discharge hole surface
6 . . . second flow channel member
6*a* . . . through-hole (of second flow channel member)
8 . . . discharge hole
9A . . . discharge hole line
10 . . . pressurizing chamber
10*a* . . . pressurizing chamber body
10*b* . . . partial flow channel
11A . . . pressurizing chamber line
12, 312 . . . second flow channel
312*a* . . . second separate flow channel
312*aa* . . . first site (of second separate flow channel)
312*ab* . . . second site (of second separate flow channel)
312*b* . . . second connection flow channel
14, 114, 214 . . . first flow channel
14*a*, 114*a*, 214*a* . . . first separate flow channel
14*aa*, 114*aa*, 214*aa* . . . first site (of first separate flow channel)
14*ab*, 114*ab*, 214*ab* . . . second site (of first separate flow channel)
14*b*, 114*b*, 214*b* . . . connection flow channel
20 . . . second common flow channel
20*a* . . . second common flow channel body
20*b* . . . opening (of second common flow channel)
22 . . . first common flow channel
22*a* . . . first common flow channel body
22*b* . . . opening (of first common flow channel)
24 . . . first integration flow channel

24*a* . . . first integration flow channel body
22*b* . . . opening (of first integration flow channel)
26 . . . second integration flow channel
26*a* . . . second integration flow channel body
22*b* . . . opening (of second integration flow channel)
28A, 28B . . . damper
29A, 29B . . . damper chamber
40 . . . piezoelectric actuator substrate
40*a* . . . piezoelectric ceramic layer
40*b* . . . piezoelectric ceramic layer (vibration plate)
42 . . . common electrode
44 . . . separate electrode
44*a* . . . separate electrode body
44*b* . . . extraction electrode
46 . . . connection electrode
50 . . . displacement element (pressurizing part)
70 . . . head mounting frame
72 . . . head group
80A . . . paper feed roller
80B . . . recovery roller
82A . . . guide roller
82B . . . conveyance roller
88 . . . control part
D1 . . . first direction
D2 . . . second direction
D3 . . . third direction
D4 . . . fourth direction
P . . . printing paper sheet

The invention claimed is:

1. A liquid discharge head comprising:
a flow channel member that includes
a plurality of discharge holes,
a plurality of pressurizing chambers that are linked to the plurality of discharge holes, respectively,
one or more first common flow channels that are commonly linked to the plurality of pressurizing chambers,
one or more second common flow channels that are commonly linked to the plurality of pressurizing chambers,
a first flow channel that links the plurality of pressurizing chambers and the one or more first common flow channels, and
a second flow channel that links the plurality of pressurizing chambers and the one or more second common flow channels, and
a plurality of pressurizing parts that pressurize the plurality of pressurizing chambers, respectively, wherein
the first flow channel includes a first connection flow channel that connects the one or more first common flow channels and a plurality of first separate flow channels that are linked to one of the pressurizing chambers of the plurality of pressurizing chambers, and
one of the one or more first common flow channels includes a plurality of sets that are composed of the first connection flow channel and the plurality of first separate flow channels, wherein, at a connection point where the plurality of first separate flow channels and the first connection flow channel are connected, a first angle between two of the first separate flow channels is greater than a second angle between one of the two of the first separate flow channels and the first connection flow channel.

2. The liquid discharge head according to claim 1, wherein, for any two of the first separate flow channels that are connected at the connection point, the first angle is greater than the second angle.

3. A liquid discharge head comprising:
a flow channel member that includes
a plurality of discharge holes,
a plurality of pressurizing chambers that are linked to the plurality of discharge holes, respectively,
one or more first common flow channels that are commonly linked to the plurality of pressurizing chambers,
one or more second common flow channels that are commonly linked to the plurality of pressurizing chambers,
a first flow channel that links the plurality of pressurizing chambers and the one or more first common flow channels, and
a second flow channel that links the plurality of pressurizing chambers and the one or more second common flow channels, and
a plurality of pressurizing parts that pressurize the plurality of pressurizing chambers, respectively, wherein
the first flow channel includes a first connection flow channel that connects the one or more first common flow channels and a plurality of first separate flow channels that are linked to one of the pressurizing chambers of the plurality of pressurizing chambers, and
one of the one or more first common flow channels includes a plurality of sets that are composed of the first connection flow channel and the plurality of first separate flow channels, wherein the one or more first common flow channels extend in a first direction and are aligned in a second direction that intersects with the first direction, and in a plan view, the first flow channel, that is linked to the discharge holes of the plurality of discharge holes that are arranged in a first region between two first common flow channels of the one or more first common flow channels, is arranged to fall within the first region.

4. The liquid discharge head according to claim 3, wherein the one or more first common flow channels and the first flow channel are arranged to be closer to a discharge hole surface where the plurality of discharge holes are opened than the one or more second common flow channels.

5. The liquid discharge head according to claim 3, wherein the one or more second common flow channels extend in the first direction and are aligned in the second direction, and in the plan view, the one or more first common flow channels and the one or more second common flow channels are arranged to be overlapped.

6. The liquid discharge head according to claim 5, wherein, in the plan view, the first flow channel, that is linked to the discharge holes of the plurality of discharge holes that are arranged in a second region between two second common flow channels of the one or more second common flow channels, is arranged to fall within the second region.

7. A liquid discharge head comprising:
a flow channel member that includes
a plurality of discharge holes,
a plurality of pressurizing chambers that are linked to the plurality of discharge holes, respectively,
one or more first common flow channels that are commonly linked to the plurality of pressurizing chambers,
one or more second common flow channels that are commonly linked to the plurality of pressurizing chambers, a first flow channel that links the plurality of pressurizing chambers and the one or more first common flow channels, and a second flow channel that links the plurality of pressurizing chambers and the one or more second common flow channels, and a plurality of pressurizing parts that pressurize the plurality of pressurizing chambers, respectively, wherein the first flow channel includes a first connection flow channel that connects the one or more first common flow channels and a plurality of first separate flow channels that are linked to one of the pressurizing chambers of the plurality of pressurizing chambers, and one of the one or more first common flow channels includes a plurality of sets that are composed of the first connection flow channel and the plurality of first separate flow channels, wherein at least a part of the flow channel member includes a plurality of plates that are laminated, where at least one of a hole and a groove is arranged on each plate of the plurality of plates, the plurality of first separate flow channels are configured to link holes or grooves that are arranged on the plurality of plates, each separate flow channel of the plurality of first separate flow channels includes a first site that is directly linked to a corresponding pressurizing chamber of the plurality of pressurizing chambers and is arranged on one plate of the plurality of plates, and a second site that is arranged on another plate of the plurality of plates that is different from the one plate where the first site is arranged, and links the first site and the first connection flow channel, and a flow channel resistance per unit length of the first site is greater than a flow channel resistance per unit length of the second site.

8. The liquid discharge head according to claim 7, wherein a thickness of the another plate that composes the second site is greater than a thickness of the one plate that composes the first site.

9. A recording apparatus comprising the liquid discharge head according to claim 1, a conveyance part that conveys a printing paper sheet to the liquid discharge head, and a control part that controls the liquid discharge head.

10. A recording apparatus comprising the liquid discharge head according to claim 1, and a coater that applies a coating agent to a printing paper sheet.

11. A recording apparatus comprising the liquid discharge head according to claim 1, and a dryer that dries a printing paper sheet.

12. A recording apparatus comprising the liquid discharge head according to claim 3, a conveyance part that conveys a printing paper sheet to the liquid discharge head, and a control part that controls the liquid discharge head.

13. A recording apparatus comprising the liquid discharge head according to claim 3, and a coater that applies a coating agent to a printing paper sheet.

14. A recording apparatus comprising the liquid discharge head according to claim 3, and a dryer that dries a printing paper sheet.

15. A recording apparatus comprising the liquid discharge head according to claim 7, a conveyance part that conveys a printing paper sheet to the liquid discharge head, and a control part that controls the liquid discharge head.

16. A recording apparatus comprising the liquid discharge head according to claim 7, and a coater that applies a coating agent to a printing paper sheet.

17. A recording apparatus comprising the liquid discharge head according to claim 7, and a dryer that dries a printing paper sheet.

18. The liquid discharge head according to claim 1, wherein a connection position of the first flow channel to the plurality of pressurizing chambers is closer to the plurality of discharge holes than a connection position of the second flow channel to the plurality of pressurizing chambers.

19. The liquid discharge head according to claim 1, wherein the first connection flow channel is longer than the plurality of first separate flow channels.

20. The liquid discharge head according to claim 1, wherein a flow channel resistance of the plurality of first separate flow channels is greater than a flow channel resistance of the first connection flow channel.

* * * * *